US006280210B1

(12) United States Patent
Sikora et al.

(10) Patent No.: US 6,280,210 B1
(45) Date of Patent: Aug. 28, 2001

(54) IGNITION WIRING CONNECTOR

(75) Inventors: Ken Sikora, Fort Wayne; Walt Strasser, Grabill, both of IN (US)

(73) Assignee: Garrett Products, Inc., Fort Wayne, IN (US)

( * ) Notice: Subject to any disclaimer, the term of this patent is extended or adjusted under 35 U.S.C. 154(b) by 0 days.

(21) Appl. No.: 09/546,454

(22) Filed: Apr. 10, 2000

(51) Int. Cl.[7] ..... H01R 13/44
(52) U.S. Cl. ..... 439/127; 439/848
(58) Field of Search ..... 439/125, 127, 439/851, 854, 839, 848

(56) References Cited

U.S. PATENT DOCUMENTS

| | | | | |
|---|---|---|---|---|
| 2,792,558 | | 5/1957 | Woffter | 339/26 |
| 2,904,769 | | 9/1959 | Sampson et al. | 339/26 |
| 3,246,284 | * | 4/1966 | Farison | 439/851 |
| 3,793,616 | * | 2/1974 | Moehrke | 439/854 |
| 3,918,789 | | 11/1975 | Davis | 339/245 |
| 4,009,924 | * | 3/1977 | Bungo et al. | 439/839 |
| 4,037,914 | | 7/1977 | Fetzer | 339/253 R |
| 4,859,194 | | 8/1989 | Bartholomew | 439/125 |
| 4,997,380 | | 3/1991 | Etienne et al. | 439/127 |
| 5,409,388 | | 4/1995 | Phillips, Jr. et al. . | |

FOREIGN PATENT DOCUMENTS

| | | | |
|---|---|---|---|
| 0 121 637 A1 | 10/1984 | (EP) | H01R/19/68 |

* cited by examiner

*Primary Examiner*—Neil Abrams
*Assistant Examiner*—Brian S. Webb
(74) *Attorney, Agent, or Firm*—Taylor & Aust, P.C.

(57) ABSTRACT

A one-piece electrical connector for connecting an insulated conductor to a generally cylindrical conductive terminal post includes a first connector portion formed as an open-ended cylindrical shell segment of about the same axial length as the terminal post and having an inner circumference to snugly completely encircle the terminal post. The shell has a sidewall deformation intermediate the segment ends for retaining the connector on the post. A second connector portion grips the insulated conductor piercing the insulation and making electrical contact with the conductor.

17 Claims, 3 Drawing Sheets

IGNITION WIRING CONNECTOR

BACKGROUND OF THE INVENTION

1. Field of the Invention

The present invention relates to electrical connectors and more particularly to a connector for selectively connecting an insulated conductor to a conductive terminal post, for example, of the type commonly found in automotive ignition systems.

2. Description of the Related Art

Automotive ignitions systems frequently have a cable or similar insulated conductor connecting a distributor terminal to a corresponding spark plug. The spark plug characteristically has a central terminal post to which one end of the cable connects. The plug body is grounded to the engine head or block. The spark plug end of the cable may have an electrical connector or terminal which is crimped to the cable contacting the cable conductor and having a free end for selectively gripping the central terminal post. The distributor end of the cable may also have an electrical connector crimped to the cable contacting the cable conductor and having a free end for selectively gripping a distributor post. The connector may be of a straight variety where the cable extends away from the terminal post generally in alignment with the terminal axis, or may be of an orthogonal variety where the cable extends away from the post generally perpendicular to the axis of the post. The distributor may have a terminal post to which the distributor end of the cable connects, or may have a cavity into which a conductive sleeve which is crimped to the cable end and contacts the conductor may be inserted. Spark plug connectors are frequently, but not necessarily, of the straight variety and distributor terminal connectors are typically, but not always, of the orthogonal variety.

It is important that the connector be relatively easily removed from the terminal post for engine maintenance, yet securely grip the terminal post both to achieve good electrical contact and to prevent inadvertently disconnecting from the terminal post. Forming the connector from thinner material facilitates manufacture and reduces material costs, however material strength and resilience is reduced and there is a correlative reduction in the radially inward forces which serve to retain the connector on the post.

A connector as described above, while coupling with either the distributor or spark plug, may include a slot in which a spring clip is positioned. The spring clip remains within the slot, and resiliently grips the terminal of the distributor or spark plug. However, a spring clip adds another part to the assembly, thereby increasing the manufacturing and assembly costs associated with the electrical connector.

SUMMARY OF THE INVENTION

The present invention provides a connector for electrically and mechanically coupling an insulated conductor and a terminal post, such as a spark plug central terminal or distributor cap terminal, which completely encircles the post.

The invention comprises, in one form thereof, one-piece electrical connector having an open-ended cylindrical shell segment formed from a flat sheet of conductive material rolled about an axis to form the cylindrical shell including a sidewall region where opposed ends of the sheet overlap, and a connector portion for gripping an insulated conductor and making electrical contact with the conductor.

An advantage of the present invention is that substantial radially inwardly forces for maintaining good electrical and mechanical connection between the connector and terminal post are achieved while the forces required to install or remove the connector are not excessive and manufacturing costs are low.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
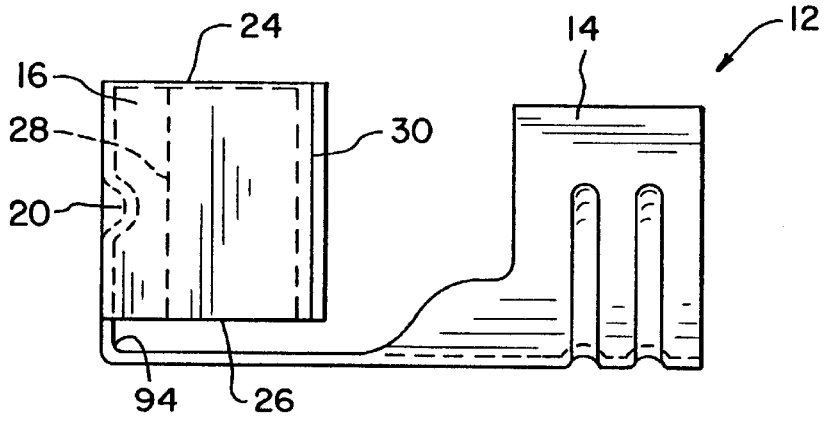
FIG. 1 is a side elevation view of an electrical connector according to the invention in one form.
Figure 2:
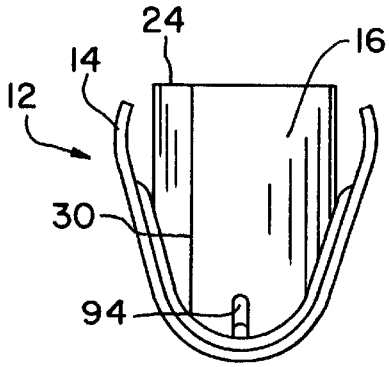
FIG. 2 is an end elevation view of the FIG. 1 connector from the right side thereof.
Figure 4:
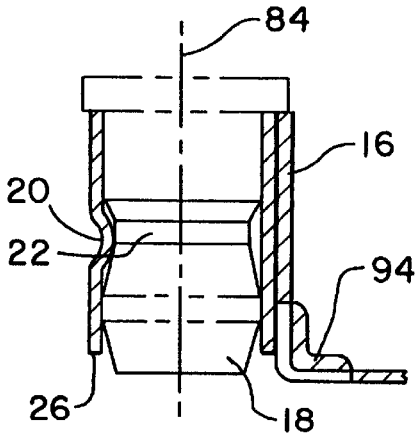
FIG. 4 is a view in cross-section along lines 4—4 of FIG. 3.

Referring now to the drawings and particularly to FIG. 1, there is shown a one-piece electrical connector 12 for connecting an insulated conductor (not shown) to a generally cylindrical conductive terminal post (18 of FIG. 4). The connector 12 includes a portion 14 for gripping the insulated conductor and piercing the insulation making electrical contact with the conductor. At the opposite connector end is an open-ended cylindrical shell segment 16 of about the same axial length as the terminal post 18 having an inner circumference sized to snugly completely encircle the terminal post 18 as best seen in FIG. 4. The shell 16 has a sidewall deformation such as dimple 20 intermediate the segment ends 24 and 26 and the terminal post 18 includes an annular groove 22 which cooperates with the dimple 20 to retain the connector on the post. The connector portion 16 is formed from a flat sheet of conductive material by rolling about an axis to form the cylindrical shell and includes a sidewall region where opposed ends 28 and 30 overlap. The shell diameter increases and the sidewall region narrows as the dimple moves radially outwardly while the connector is being installed on or removed from the terminal 18.

Figure 5:
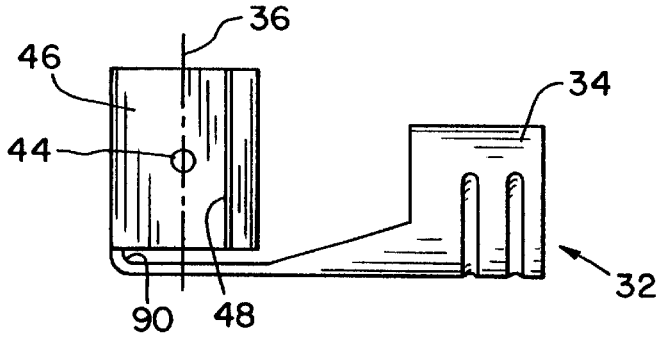
FIG. 5 is a side elevation view of an electrical connector illustrating a modification of the connector of FIGS. 1–4.
Figure 6:
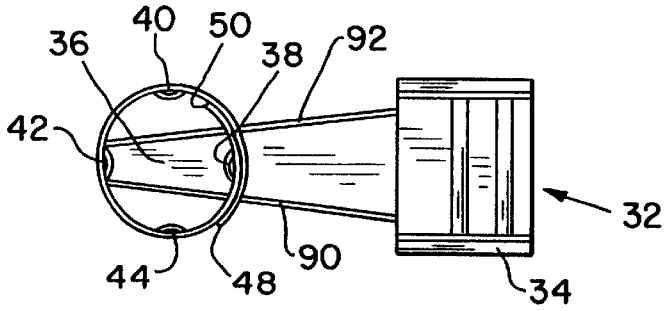
FIG. 6 is a top view of the connector of FIG. 5.

FIGS. 5 and 6 illustrate a modification to the connector 12 wherein a plurality of like dimples 38, 40, 42 and 44 are generally equiangularly spaced about the cylindrical shell 46. As before, the cylindrical shell 46 includes a sidewall overlap region between ends 48 and 50. One dimple 38 is located in the sidewall region where the opposed ends of the sheet overlap. Dimple 38 is near end 48 which is disposed radially outwardly of end 50 as seen in FIG. 5. When the shell is formed, dimple 38 is aligned with and extends radially inwardly through an opening 52 formed near the other sheet end 50. The overlap would prevent dimple 38 from engaging a terminal groove such as 22 were it not for the dimple passing opening 52.

Comparing FIGS. 1 and 6, it will be noted that for both connector 12 and connector 32, when an insulated conductor is gripped by the portion 14 or 34, the axis such as 36 of the cylindrical shell and the insulated conductor extend generally orthogonally to one another. However, in FIGS. 8 and 9, when an insulated conductor is gripped by the portion 54, the cylindrical shell 56 and the insulated conductor are in general coaxial alignment along axis 58.

Figure 8:
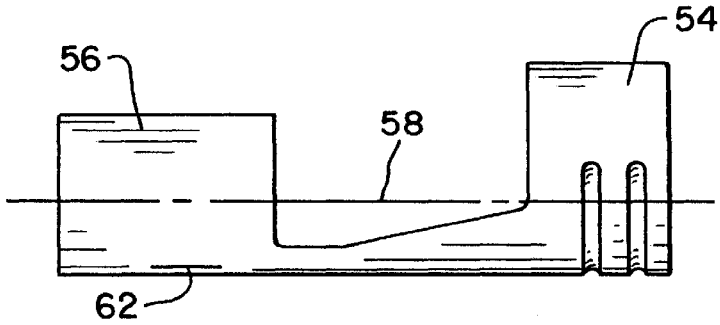
FIG. 8 is a side elevation view of an electrical connector illustrating another modification of the connector of FIGS. 1–4.
Figure 9:
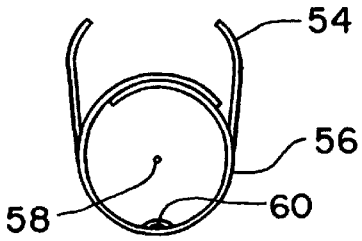
FIG. 9 is an end elevation view of the FIG. 8 connector from the left side thereof.

The straight variety connector of FIGS. 8 and 9 includes the insulated conductor receiving and gripping portion 54 which may have a pair of insulation gripping ribs as in the previous examples. This connector also includes a dimple 60 which is spanned by a pair of longitudinal sidewall slits 62 and 64 (FIG. 10) which allow some flexing of the shell 56 sidewall and limited radial motion of the deformation during placement or removal of the connector. As previously, the terminal post includes an annular groove for cooperating with the deformation to retain the connector on the post. The radially inwardly extending dimple 60 is moved radially outwardly against the natural resilience of the connector sidewall during placement on or removal from the post.

Figure 7:
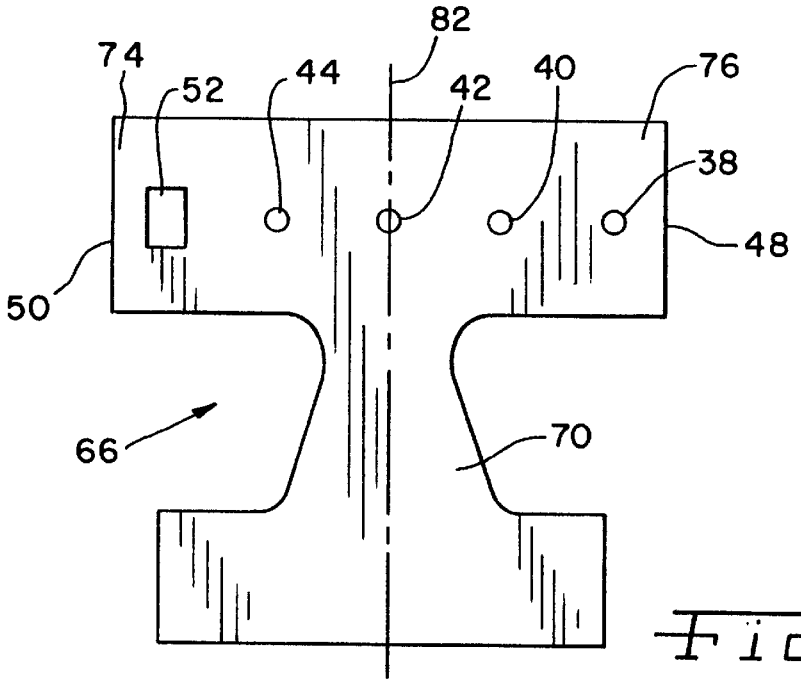
FIG. 7 is a plan view of a material blank for forming the connector of FIGS. 5 and 6.
Figure 10:
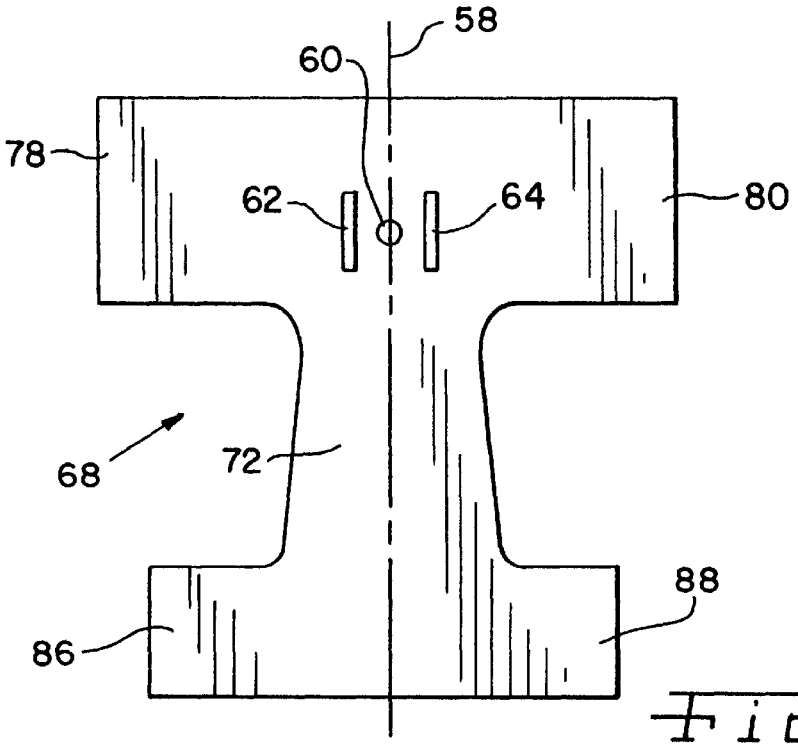
FIG. 10 is a plan view of a material blank for forming the connector of FIGS. 8 and 9.

FIGS. 7 and 10 are illustrative of connector fabrication according to the present invention. Manufacture of the connector begins by cutting a connector blank 66 or 68 from a generally planar sheet of conductive material. The blank includes a body 70 or 72 and a pair of laterally extending arms 74 and 76, or 78 and 80. Formation of any of the connectors includes deformation causing wrapping of the arms about an axis 58 or 82 which is parallel to and displaced from the plane of the sheet about the same distance as the radius of the terminal cylinder which the connector is designed to fit to form a cylindrical shell with the arms overlapping near respective remote ends. Wrapping is arbitrarily assumed to be upwardly from the plane of the paper as viewed.

In FIG. 10, this wrapping is also partially performed on the laterally extending tabs 86 and 88 to form the insulated conductor receiving cradle 54. At the same time, the central portion of the body 72 is formed into a partial cylindrical configuration which significantly stiffens the connector. When an insulated conductor is placed in the cradle 54 and the ends crimped inwardly to pierce the insulation and make contact with the conductor, the conductor extends generally along the axis 58. This is also the common axis of wrapping and results in coaxial alignment of the insulated conductor and terminal. Of course, contact may be achieved in other conventional ways. Deformation of the cylindrical shell sidewall portions to form radially inwardly extending dimples and the formation of shell apertures such as 52 and resilience control slits 62 and 64 may occur when the conductor is in the blank stage as in FIGS. 7 and 10, or later in the fabrication process as desired.

Figure 3:
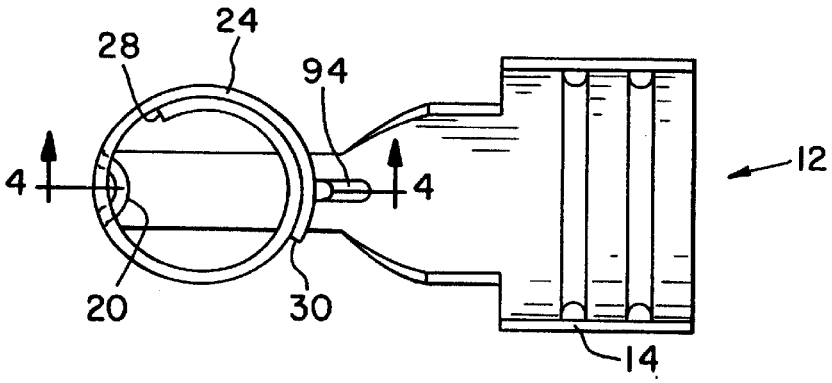
FIG. 3 is a top view of the connector of FIG. 1.

In FIGS. 5 and 6, the shell axis 36 is orthogonal to the axis of the insulated conductor when the conductor is received in cradle 34. Wrap axis 82 may correspond to one or the other of these axes depending on the order in which fabrication proceeds. In either case, when the right angle bend between the cylindrical shell 46 and the conductor crimping portion or cradle 34 takes place, stiffening rib portions 90 and 92 are formed by bending opposed edges of the narrow central portion of the connector blank toward one another and normal to the plane of the blank. A centrally located rib such as 94 in FIGS. 1 and 3 is an alternative technique for reinforcing the region of the right angle bend.

Although the electrical connector of the present invention is described above in association with a spark plug, it is also to be appreciated that the electrical connector may have other uses, such as at the distributor or coil end of an insulated electrical conductor.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A one-piece electrical connector for connecting an insulated conductor to a generally cylindrical conductive terminal post, comprising:

a first connector portion comprising an open-ended cylindrical shell segment of about the same axial length as the terminal post and having an inner circumference to snugly completely encircle the terminal post, the shell having opposite segment ends and at least one sidewall deformation intermediate the segment ends for retaining the connector on the post and a pair of longitudinal sidewall slits spanning the deformation and structured and arranged for allowing limited radial motionof the deformation; the deformation being formed near one segment end, and aligned with and extending radially inwardly through an opening defined near the other segment end and a second connector portion for gripping the insulated conductor and making electrical contact with the conductor.

2. The connector of claim 1, wherein the terminal post includes an annular groove for cooperating with the deformation to retain the connector on the post, the deformation comprising a radially inwardly extending dimple which is moved radially outwardly against the natural resilience of the connector sidewall during placement on or removal from the post.

3. The connector of claim 1, wherein the first connector portion is formed from a flat sheet of conductive material rolled about an axis to form the cylindrical shell and includes a sidewall region where opposed ends of the sheet overlap.

4. The connector of claim 3, wherein the terminal post includes an annular groove for cooperating with the deformation to retain the connector on the post, the deformation comprising at least one radially inwardly extending dimple which is moved radially outwardly against the natural resilience of the connector sidewall during placement on or removal from the post, the sidewall region narrowing as the dimple moves radially outwardly and widening as the dimple moves radially inwardly.

5. The connector of claim 4, wherein there are a plurality of like dimples generally equiangularly spaced about the cylindrical shell.

6. The connector of claim 5, wherein at least one dimple is located in the sidewall region where the opposed ends of the sheet overlap, the dimple being formed near one sheet end, aligned with and extending radially inwardly through an opening near the other sheet end.

7. The connector of claim 1, wherein, when an insulated conductor is gripped by the second portion, the cylindrical shell and the insulated conductor are in general coaxial alignment.

8. The connector of claim 1, wherein, when an insulated conductor is gripped by the second portion, the cylindrical shell and the insulated conductor extend generally orthogonally to one another.

9. A one-piece electrical connector for connecting an insulated conductor to a generally cylindrical conductive terminal post, comprising:

a first connector portion comprising an open-ended cylindrical shell segment formed from a flat sheet of conductive material rolled about an axis to form a cylindrical shell including a sidewall region where opposed ends of the sheet overlap, at least one deformation located in the sidewall region where the opposed ends of the sheet overlap, the deformation being formed near one sheet end, and aligned with and extending radially inwardly through an opening defined near the other sheet end; and a second connector portion for gripping the insulated conductor and making electrical contact with the conductor.

10. The connector of claim 9, further comprising a pair of longitudinal sidewall slits spanning the deformation and allowing limited radial motion of the deformation.

11. The connector of claim 9, wherein, when an insulated conductor is gripped by the second portion, the cylindrical shell and the insulated conductor are in general coaxial alignment.

12. The connector of claim 9, wherein, when an insulated conductor is gripped by the second portion, the cylindrical shell and the insulated conductor extend generally orthogonally to one another.

13. The connector of claim 9, wherein the shell includes at least one sidewall deformation intermediate the segment ends for retaining the connector on the post.

14. The connector of claim 13, wherein the terminal post includes an annular groove for cooperating with the deformation to retain the connector on the post, the deformation comprising a radially inwardly extending dimple which is moved radially outwardly against the natural resilience of the connector sidewall during placement on or removal from the post.

15. The connector of claim 13, wherein the terminal post includes an annular groove for cooperating with the deformation to retain the connector on the post, the deformation comprising at least one radially inwardly extending dimple which is moved radially outwardly against the natural resilience of the connector sidewall during placement on or removal from the post, the sidewall region narrowing as the dimple moves radially outwardly and widening as the dimple moves radially inwardly.

16. The connector of claim 13, wherein there are a plurality of like deformations generally equiangularly spaced about the cylindrical shell.

17. A method of making a connector for electrically connecting an insulated conductor and a generally cylindrical terminal post, comprising:

cutting a connector blank from a generally planar sheet of conductive material with a body and a pair of laterally extending arms;

an axis which is parallel to and displaced from the plane of the wrapping the arms about an axis which is parallel to and displaced from the plane of the sheet about the same distance as the radius of the terminal cylinder to form a cylindrical shell with the arms overlapping near respective remote ends;

deforming a portion of the cylindrical shell to form a radially inwardly extending dimple near an edge of one of said arms;

forming an opening near an edge of the other of said arms;

positioning said dimple through said opening; and mechanically and electrically connecting an insulated conductor to the body.

* * * * *

UNITED STATES PATENT AND TRADEMARK OFFICE

CERTIFICATE OF CORRECTION

PATENT NO. : 6,280,210 B1
DATED : August 28, 2001
INVENTOR(S) : Ken Sikora et al.

It is certified that error appears in the above-identified patent and that said Letters Patent is hereby corrected as shown below:

Column 4,
Line 37, delete “motionof” and insert -- motion of -- therefor.
Line 38, after “deformation” delete “;” and insert -- , -- therefor.
Line 41, after “end” insert -- ; -- therefor.

Column 6,
Lines 26-27, delete “an axis which is parallel to and displaced from the plane of the” therefor.

Signed and Sealed this

Twenty-fourth Day of September, 2002

*Attest:*

*Attesting Officer*

JAMES E. ROGAN
*Director of the United States Patent and Trademark Office*